United States Patent [19]

Negrin

[11] 4,302,889

[45] Dec. 1, 1981

[54] BOOT TO BE WORN AFTER SKIING

[76] Inventor: Celeste Negrin, Via Schiavonesca Nuova n.358, 31040 Selva Del Montello (Treviso), Italy

[21] Appl. No.: 116,576

[22] Filed: Jan. 29, 1980

[30] Foreign Application Priority Data

Jul. 11, 1979 [IT] Italy ..... 83418 A/79

[51] Int. Cl.[3] ..... A43B 1/10

[52] U.S. Cl. ..... 36/4; 36/7.3

[58] Field of Search ..... 36/4, 3 R, 3 A, 7.1 R, 36/7.3, 117

[56] References Cited

U.S. PATENT DOCUMENTS

| | | | |
|---|---|---|---|
| 2,703,937 | 3/1955 | McGinn | 36/3 R |
| 3,044,188 | 7/1962 | Evangelista | 36/3 R |
| 3,264,761 | 8/1966 | Johnson | 36/3 A |
| 3,410,004 | 11/1968 | Finn | 36/71 |

*Primary Examiner*—Patrick D. Lawson

*Attorney, Agent, or Firm*—Bucknam and Archer

[57] ABSTRACT

A boot suitable for after skiing is described which comprises a sole portion, an exterior vamp portion connected to the sole portion, the exterior vamp portion being turned at the top to form a turned over portion, an interior layer continuous with the turned over vamp portion, a chamber between the exterior portion and the interior layer, the chamber being closed and being inaccessible to the exterior environment. The ski boot may be of knee-high type or ankle-high type. The interior layer may be manufactured separate from the vamp portion and may be joined to the vamp portion by a seam. The interior layer may consist of a stocking which is joined to the top edge of the vamp portion, the stocking having the shape of a foot opposite to the foot portion of the boot, with the stocking being turned in the interior of the boot.

3 Claims, 2 Drawing Figures

BOOT TO BE WORN AFTER SKIING

The present invention relates to footwear and more specifically to footwear for use after skiing of the type which may be either of knee-high or ankle-high type.

A great variety of boots for use after skiing are known in the art, particularly of the knee-high type and of the ankle-high type. All these different types of boots are generally internally padded with nylon and/or with a synthetic foamed material together with a lining made of velvet or wool or another synthetic material which may be more or less flexible.

The different types of boots are substantially characterized by the presence of a portion extending up to the knee preferably of a padded type and this portion is joined to the sole in an integral body forming in this manner a vamp. In the interior of the knee-high portion or the vamp, a stocking is inserted, this stocking being made of a material which is more or less similar or other suitable material such as foamed material so that in this manner there is formed a substantially double layer of the knee portion and in this manner there is achieved a space between the layers which better maintains the temperature of the foot and the leg which are fitted in the boots.

One of the drawbacks of the boots known in the art is that they consist of two separate elements, one being inserted within the other and particularly a vamp with a stocking which are separated and at a distance one from the other. This feature presents the main drawback that a closed chamber is not formed between the external layer, that is the vamp and the internal layer stocking. It is clear that snow may penetrate into this space or in any event moisture can penetrate so that the advantages of the double layers are lost or at least reduced.

Still another disadvantage is due to the fact that in order to prepare a boot of this type it is necessary to provide for the manufacture of two distinct elements and more particularly a first element which is the vamp joined to the sole forming an integral body which constitutes the exterior boot and a second element which comprises the stocking, the latter being inserted in the interior of the boot after it has been separately manufactured.

One object of the present invention is to provide for a novel boot suitable for after skiing which is free from the disadvantages mentioned hereinabove.

Another object of the present invention is to provide a novel method for the manufacture of the novel boots suitable for after skiing, which method of manufacture is substantially simpler than other methods known in the art.

In accordance with the present invention, the novel boot suitable for after skiing of the ankle-high type or knee-high type consists of a single body consisting essentially of the sole which is connected with the vamp, the vamp being prolonged by the stocking which is opposite to the vamp, the latter terminating in the stocking itself. In this manner, the stocking results connected in an integral body with the vamp or it may be seamed to it in a single step, followed by a step of turning the stocking inside, this stocking being opposite to the foot and having the shape of an inverted foot. In this manner, after the stocking is turned inside, the stocking is in the interior of the vamp and the boot suitable for after skiing is manufactured with a double space and within this space there is formed a closed chamber which is perfectly separate from the environment and inaccessible to extraneous material or atmospheric moisture.

The properties mentioned hereinabove will be better illustrated by the following detailed description of one embodiment of the invention together with the accompanying drawing of which:

As it is clear from the figures, the boot according to the present invention consists of an exterior portion A and a portion which is intended to constitute the interior and is designated by the letter B. The boot consists of vamp 1 which may be of knee-high length or ankle-high length and which is connected to the sole and stocking 2 which is joined to the vamp and which has the shape of a foot, the stocking being arranged opposite to the portion of the foot of the vamp 1 but is slightly smaller in order to be inserted within the foot portion of the vamp 1 after it has been turned inside. The stocking 2 represents the continuation of the vamp.

Figure 1:
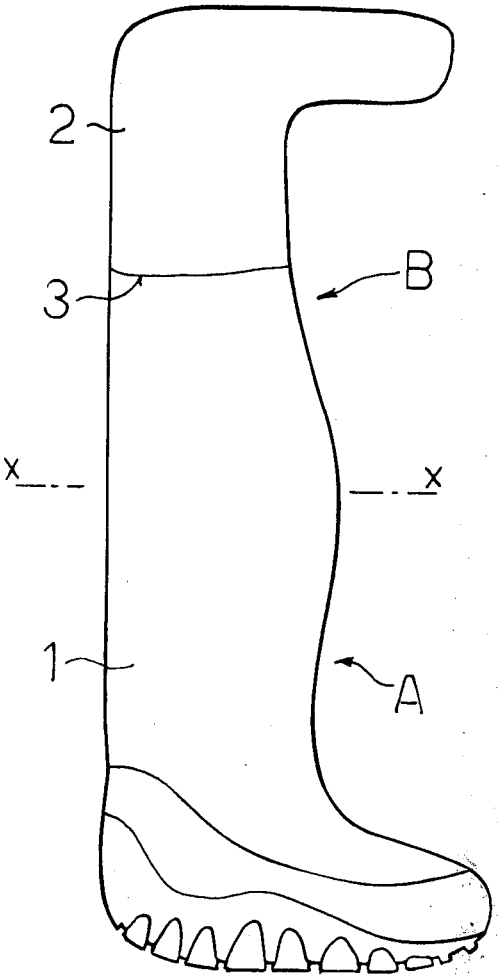
FIG. 1 is a side elevational view of the boot according to the present invention, completely open, that is prior to the step in which the stocking is turned inside.

In the particular case of FIG. 1, the vamp letter A is prolonged above the height of a knee-high boot beyond the line xx, the vamp being designated by numeral 1. The vamp is seamed to the stocking 2 as shown by numeral 3. The stocking 2 in the specific case of FIG. 1 results in a knee-high portion shorter with respect to the vamp 1.

Figure 2:
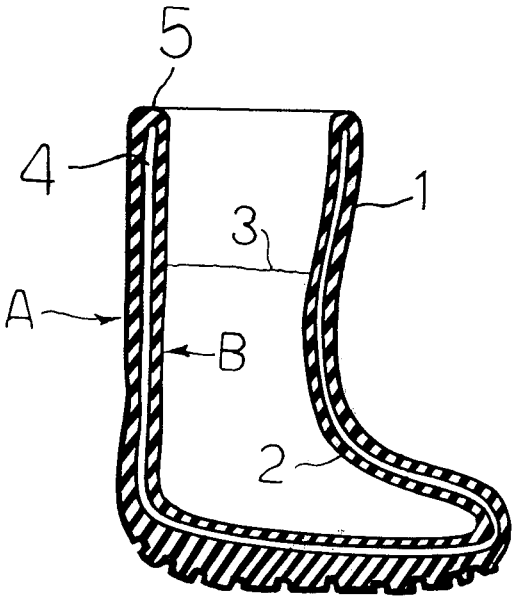
FIG. 2 is an elevational side view along the vertical plane of FIG. 1 after the stocking has been turned in the interior of the vamp.

After the boot is manufactured in the manner represented in FIG. 1, the lining designated by the letter B or the stocking is turned in the interior of the portion A in order to achieve the final shape shown in FIG. 2. Clearly, in this manner, there is achieved a closed chamber 4 which is inaccessible to external atmospheric agents and which is totally separate from the environment. Further, the boot is free of any seams at the top edge of the boot.

Naturally, the point of seam 3 may be moved more or less up or down along the height or the boot and further vamp 1 may be manufactured with the stocking 2 as an integral body.

From the foregoing description and FIGS. 1 and 2 the artisan will appreciate that the invention provides certain very advantageous improvements in a boot having a hollow shell structure A defining an exterior sole portion and an exterior vamp portion which is connected to the sole portion. The vamp portion includes a circumferential collar portion 5 through which the foot of the wearer is inserted into the boot. It should further be recognized that by way of example, FIGS. 1 and 2 show a boot in which the vamp 1 has a prominently extended shaft section leading up to the collar 5, and that the invention is applicable to boots in which the collar 5 is located at different distances above the sole. It should therefore be understood that the term boot as used herein includes boots of any height, such as knee-high boots as well as ankle-high boots, the difference merely being in the length of the shaft section of the vamp 1. Likewise, the invention is applicable to shoes in which the vamp 1 has no significant shaft section.

The interior liner 2 can be considered as a stocking and in fact has a typical boot-shaped configuration whether such liner is placed inside the outer shell A as in FIG. 2 or is placed in its inside-out configuration as shown in FIG. 1. The liner 2 is disposed to extend within the hollow outer shell structure A in a normal configuration, shown by FIG. 2, to receive the foot of the wearer.

The invention provides means defining a connection securing the liner 2 to said outer shell structure A along a circumferentially extending connection path 3 and this establishes between the liner 2 and outer shell structure A a totally enclosed space 4 when the liner 2 is in its normal configuration. The connection along the path 3 furthermore allows the liner 2 to be removed from the outer shell structure A while connected thereto as exemplified by FIG. 1 to position the liner 2 in an inside-out configuration in which the liner 2 and outer shell structure A are in opposed relation about the connection path 3 to facilitate establishing such connection about the path 3.

What is claimed is:

1. In a boot having a hollow outer shell structure defining an exterior sole portion and an exterior vamp portion connected to said sole portion, said vamp portion including a circumferential collar portion through which the foot of the wearer is inserted into the boot; and an interior liner disposed to extend within said hollow outer shell structure in a normal configuration to receive the foot of the wearer, the improvement which comprises means defining a connection securing said liner to said outer shell structure along a circumferentially extending connection path and establishing between said liner and outer shell structure a totally enclosed space when the liner is within the outer shell structure in said normal configuration, said connection means allowing the liner to be removed from the outer shell structure while connected thereto to position said liner in an inside-out configuration in which the liner and outer shell structure are in opposed relation about said connection path to facilitate establishing said connection means.

2. The improvement according to claim 1 wherein said connection path is located inwardly of said collar portion when said liner is within the outer shell structure in said normal configuration.

3. The improvement according to claim 1 wherein said liner has a foot-shaped configuration.

* * * * *